US006243888B1

(12) United States Patent
Shimizu

(10) Patent No.: US 6,243,888 B1
(45) Date of Patent: Jun. 12, 2001

(54) HAIR WASHER

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/476,186

(22) Filed: Jan. 3, 2000

(30) Foreign Application Priority Data

Jun. 16, 1999 (JP) ..... 11-169101

(51) Int. Cl.[7] ..... A45D 19/08; A45D 19/14
(52) U.S. Cl. ..... 4/515
(58) Field of Search ..... 4/515, 520–522, 4/601, 620

(56) References Cited

U.S. PATENT DOCUMENTS 3,965,496 * 6/1976 Grelle ..... 4/520
4,651,361 * 3/1987 Nolan ..... 4/520
4,901,378 * 2/1990 Reddell ..... 4/515
5,450,636 * 9/1995 Graeber ..... 4/520

* cited by examiner

*Primary Examiner*—Charles B. Eloshway
(74) *Attorney, Agent, or Firm*—Burr & Brown

(57) ABSTRACT

A hair washer comprising a cistern into which the head part of a person under hair washing can be inserted, the hair washer including a plurality of washing nozzles for spouting out washing water provided at each side wall surface, rear wall surface, and front part of the bottom wall of the cistern. A drain outlet is provided for draining out washing water spouted out from the washing nozzles, the drain outlet being provided at the rear part of the bottom wall of the cistern. At least one groove extends toward the drain outlet, the groove being provided at gaps between the plurality of washing nozzles located at the front part of the bottom wall of the cistern, wherein washing water spouted out from the washing nozzles is exhausted out from the drain outlet and passes through the groove provided at the bottom wall of the cistern.

1 Claim, 5 Drawing Sheets

HAIR WASHER

FIELD OF THE INVENTION

The present invention relates to a hair washer such as those installed in a barbershop.

BACKGROUND OF THE INVENTION

FIG. 3 is an elevation illustrating a construction of a prior art hair washer.

In FIG. 3, reference numeral 1 denotes a cabinet. Reference numeral 2 denotes a cistern having an opening 2*f* in the cabinet cistern 2. Reference numeral 3 denotes a neck receiving part for supporting a nape of a person undergoing hair washing when the head is inserted into the cistern 2. Reference numeral 5 designates a face cover provided at the cistern 2 in an openable state and having an aperture 5*a* at the central part thereof. This face cover 5 covers the head of the person undergoing hair washing when the person inserts his head into the cistern 2. This face cover 5 prevents hot water from spouting to the face of a person during the hair washing. Reference numeral 6 denotes a drawable hand shower which is used for washing off hairs, shampoo agent, or conditioner agent which may have attached to the cistern 2, or in finishing the hair washing. Numeral 7 denotes a shampoo tank for storing shampoo agent. Numeral 8 designates a rinse tank for storing conditioner agent.

FIGS. 4 and 5 are a longitudinal sectional view and a plan view, respectively, schematically illustrating a construction of a prior art hair washer. FIG. 6 is a longitudinal cross-section in line II—II of the tank of the hair washer.

In these figures, the same reference numerals designate the same or corresponding portions in FIG. 3.

As shown in the figures, there are disposed shower heads S1–S12 and nozzle heads N1–N6 at both of side walls 2*a,* rear wall 2*b* and bottom wall 2*d* of the cistern 2. The shower heads S1–S12 spout hot water taken from the hot water reserve tank (not shown) in the cabinet 1. The nozzle heads N1–N6 spout hot water mixed with shampoo agent or conditioner agent, which is obtained by mixing the shampoo agent or conditioner agent taken from the shampoo tank 7 or the rinse tank 8, respectively and the hot water taken out from the hot water reserve tank(not shown) in the cabinet 1.

Also provided is a step at the bottom wall 2*d* of the cistern 2, which means that the bottom wall 2*d* is shallower on the side of the neck receiving part 3 and deeper at the rear side. Shower heads S1, S4, S6, S8, S9 and nozzle heads N3–N5 are disposed at the shallow part of the bottom wall 2*d* at the side of the neck receiving part 3 of the cistern 2, while a drain outlet 4 is disposed at the deep part of the bottom wall 2*d* at the rear side of the cistern 2.

The washing water, such as hot water spouted out from the shower heads S1–S12 and the nozzle heads N1–N6 provided at the respective walls of plates of the cistern, is made to flow on the bottom wall 2*d* of the cistern 2 and is drained out from the drain outlet 4 provided at the bottom wall 2*d* at the rear side of the cistern 2.

A description is given of the operation of the prior art hair washer having such a construction.

The hair washing operation is started in a state where the person undergoing hair washing in the cistern 2 while lying on their back. To begin, hot water is spouted out from the shower heads S1–S12 for a predetermined period of time.

Next, the hair is shampooed using hot water spouted out from the shower heads S1–S12 as well as hot water mixed with shampoo agent spouted out from nozzle heads N1–N6.

After the shampooing process is completed, the hair is rinsed. At this time, the spouting of hot water mixed with shampooing agent from nozzle heads, N1–N6 is stopped and rinsing of the shampooing agent attached to the head hairs is performed by hot water spouted out from the shower heads S1–S12.

Next, the hair is conditioned using hot water spouted out from the shower heads S1–S12 as well as hot water mixed with conditioner agent spouted out from nozzle heads N1–N6.

Next, the hair is given a final rinse by stopping the spouting of hot water mixed with conditioner agent from the nozzle heads N1–N6 and washing out the conditioner agent in the hair by using hot water spouted from the shower heads S1–S12.

In the above-described hair washing process, both the hot water spouted alone from the shower heads S1–S12 and the hot water mixed with shampoo agent or conditioner agent spouted from the nozzle heads N1–N6 flow on the bottom wall 2*d* of the cistern 2 and are drained out from the drain outlet 4 provided at the bottom wall 2*d* at the rear side of the cistern 2.

However, when the above described hair washing is carried out by the prior art hair washer, the washing water spouted alone from the washing nozzles flows above the spouting aperture of the washing nozzles provided at the bottom wall of the cistern to be drained out from the drain outlet. Thus, the pressure of the washing water spouted on the rear part of the person's head from the washing nozzle provided at the bottom wall of the cistern, is reduced, and the rear of the head of the person undergoing hair washing cannot be sufficiently washed.

SUMMARY OF THE INVENTION

It is an object of the present invention to provide a hair washer capable of keeping the spouting pressure of the washing water spouting from the washing nozzle provided at the bottom wall of the cistern at a constant pressure during the hair washing process.

This and other objects and advantages of the present invention will become apparent from the detailed description and specific embodiments described in detail herein. The description and embodiments disclosed herein are provided only for illustration since various additions and modifications within the spirit and scope of the invention will be apparent to those of skill in the art from the detailed description.

According to a first aspect of the present invention, a hair washer comprising a cistern into which the head part of a person under hair washing can be inserted, a plurality of washing nozzles for spouting out washing water, provided at both of the side wall surfaces, the rear wall surface, and the front part of the bottom wall of the cistern, a drain outlet for draining out washing water spouted out from the washing nozzle, provided at the rear part of the bottom wall of the cistern; a groove extending toward the drain outlet provided at gaps between the plurality of washing nozzles provided at the front part of the bottom wall of the cistern, and the washing water spouted out from the washing nozzle being exhausted out from the drain outlet passing through the groove provided at the bottom wall of the cistern.

DETAILED DESCRIPTION OF THE INVENTION

Embodiment 1

Figure 1:
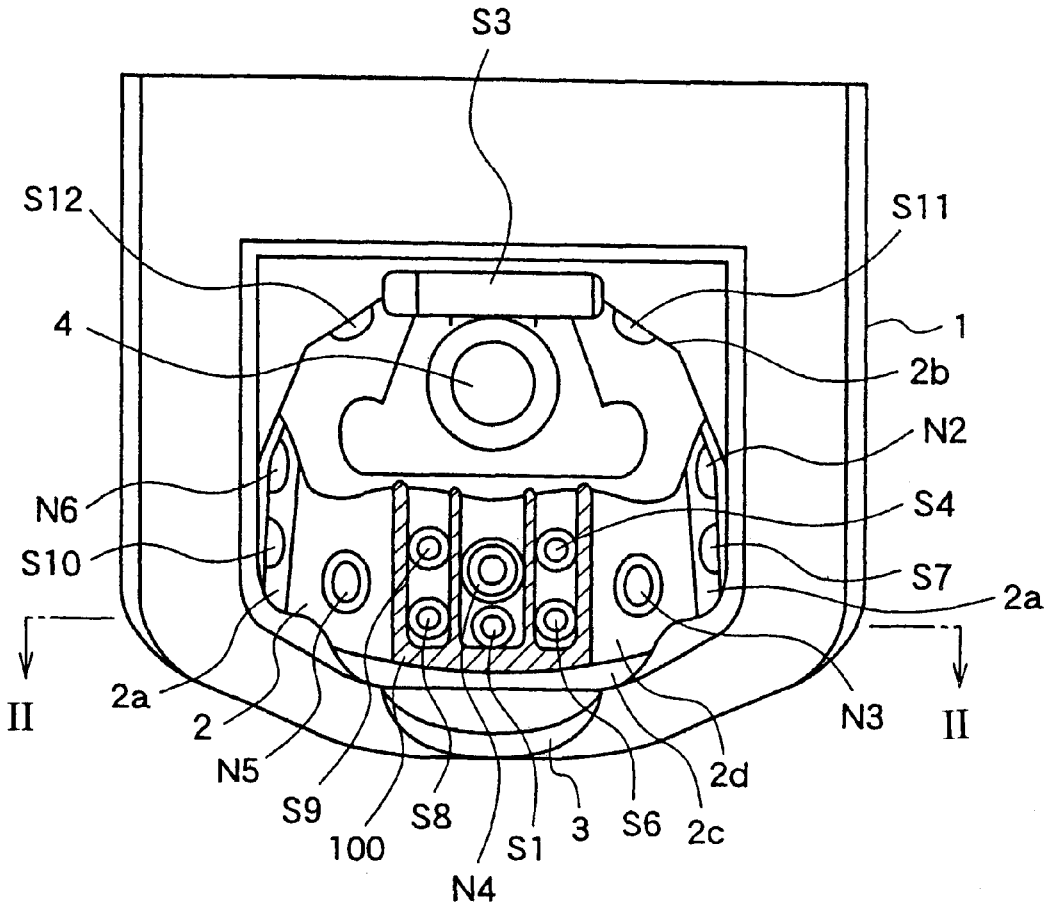
FIG. 1 is a plan view schematically illustrating a construction of a hair washer according to a first embodiment of the present invention.
Figure 2:
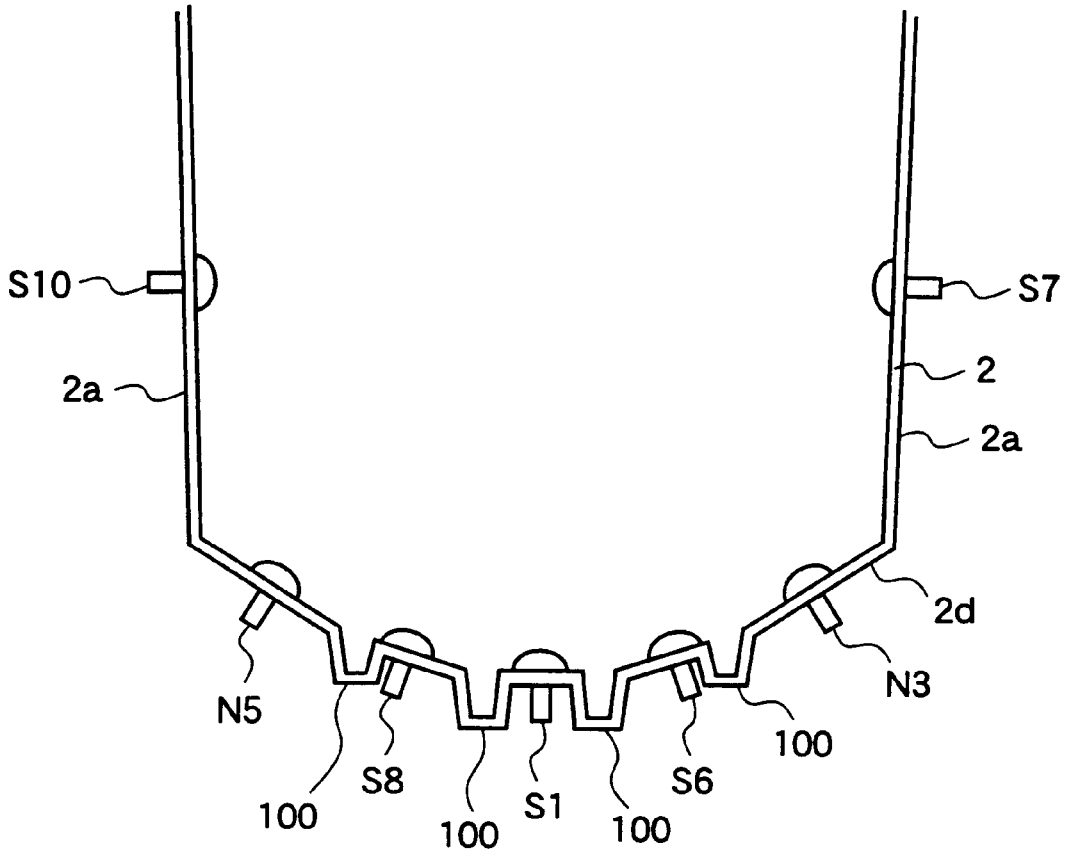
FIG. 2 is a longitudinal cross-sectional view in II—II line in FIG. 1 illustrating the cistern of the hair washer shown in FIG. 2.
Figure 3:
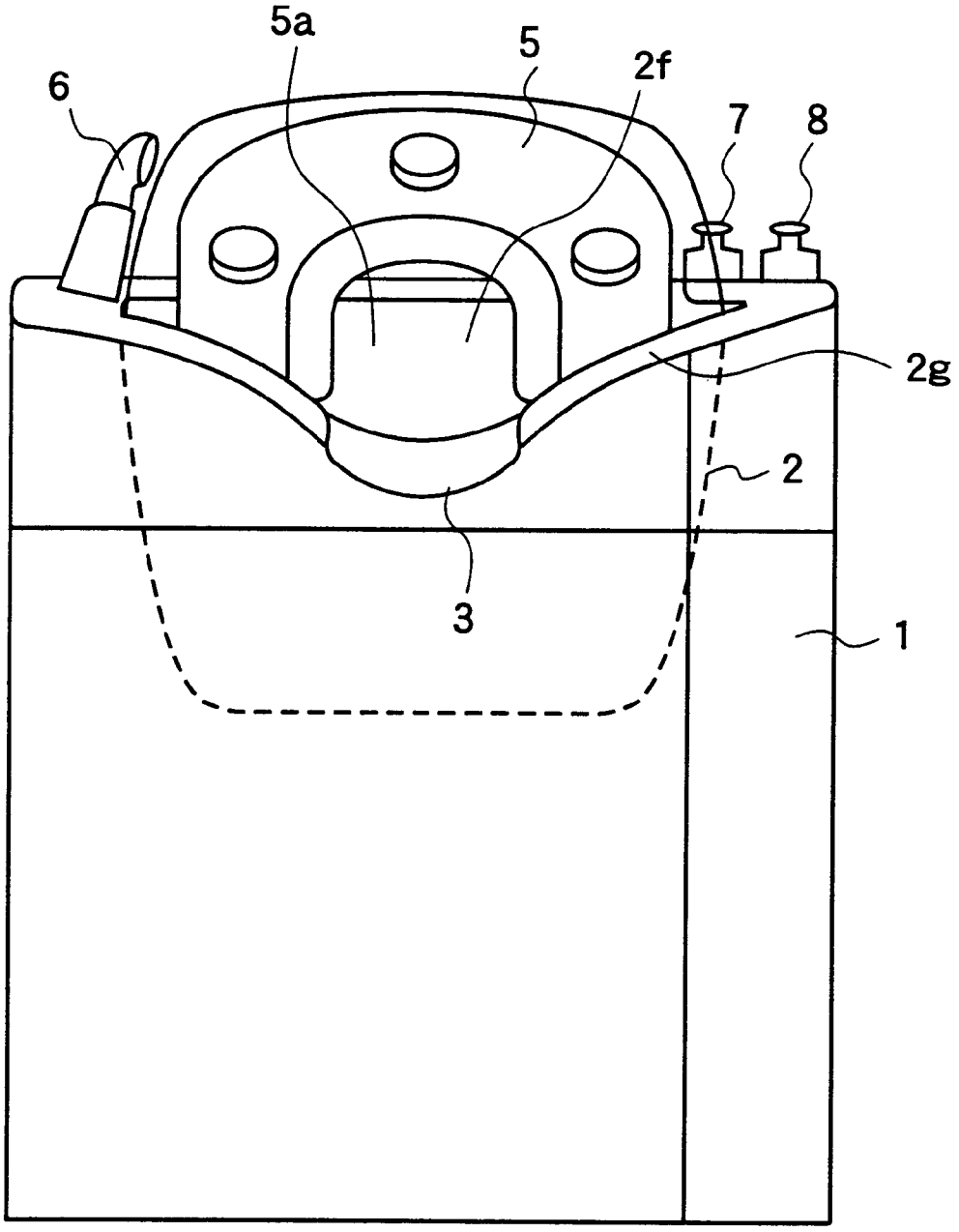
Fig.3 Prior Art
FIG. 3 is an elevation schematically illustrating the construction of the prior art hair washer.
Figure 4:
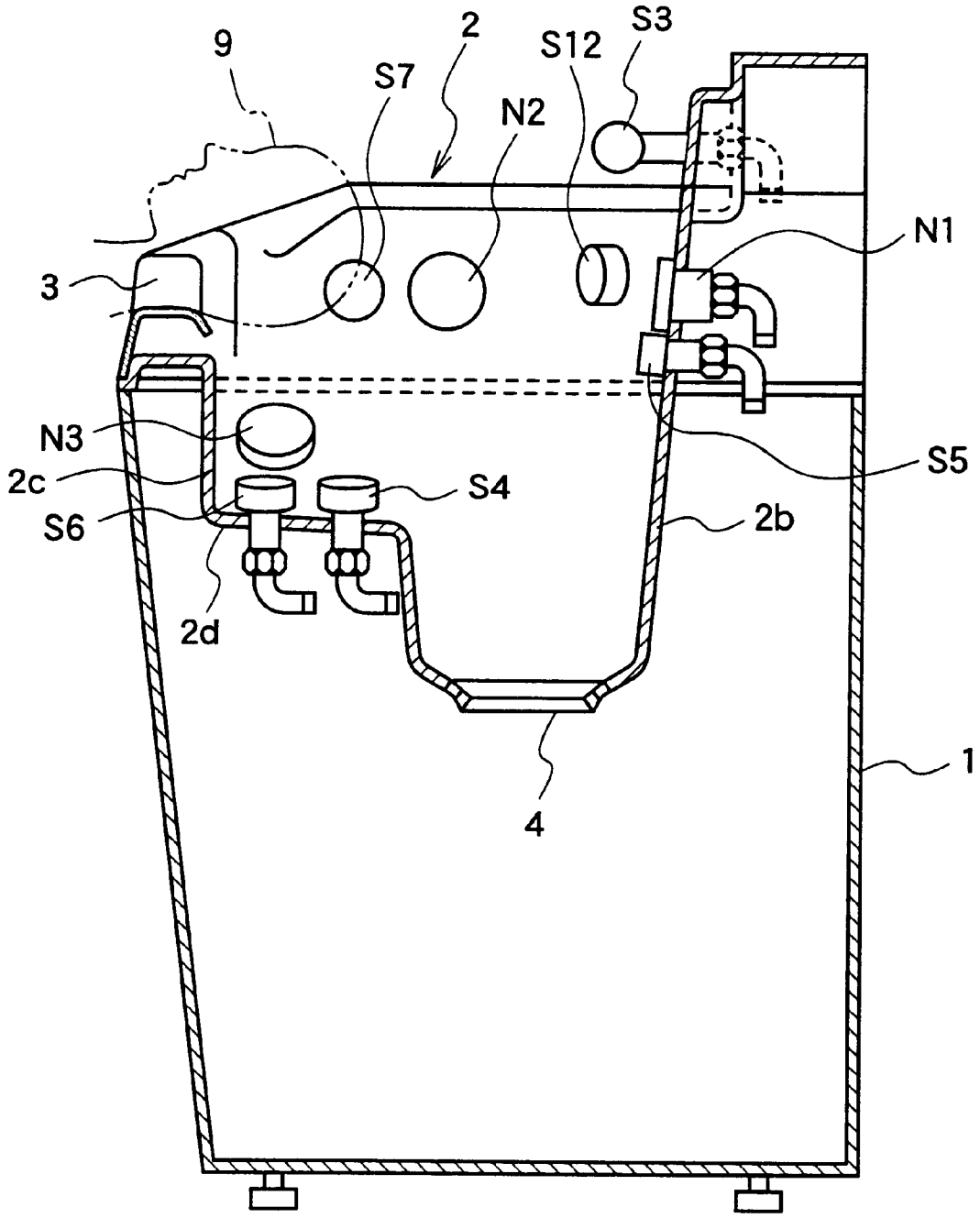
Fig.4 Prior Art
FIG. 4 is a longitudinal cross-sectional view schematically illustrating the construction of the prior art hair washer.
Figure 5:
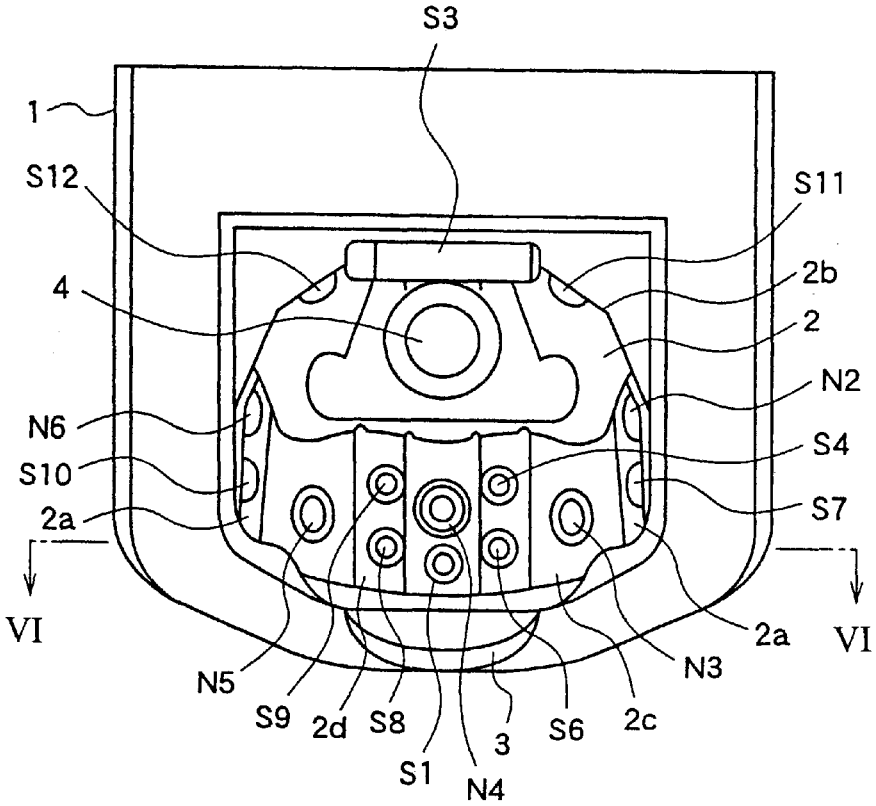
Fig.5 Prior Art
FIG. 5 is a plan view schematically illustrating the construction of the prior art hair washer.
Figure 6:
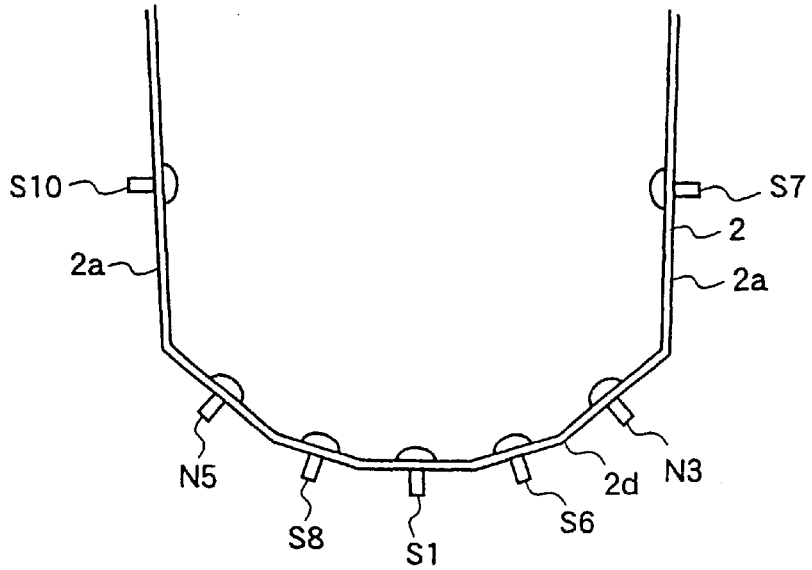
Fig.6 Prior Art
FIG. 6 is a longitudinal cross-sectional view in lines VI—VI in FIG. 5 illustrating the cistern of the hair washer.

FIG. 1 is a plan view schematically illustrating a construction of a hair washer according to a first embodiment of the present invention and FIG. 2 is a longitudinal cross-sectional view in line II—II illustrating a cistern of the hair washer shown in FIG. 1.

In the figures, reference numeral 1 denotes a cabinet. Reference numeral 2 denotes a cistern having an aperture 2*f* provided in the cabinet 1. Reference numeral 3 denotes a neck receiving part provided at the front edge part 2*g* of the cistern 2. This supports the nape part of the person undergoing hair washing when the person inserts his head into the cistern 2. Reference characters S1 to S12 denote shower heads disposed at both side walls 2*a,* the rear side wall 2*d,* and the bottom wall 2*b,* for spouting hot water. Reference characters N1 to N6 denote nozzle heads disposed at both of the side walls 2*a,* the rear side wall 2*b,* and the bottom wall 2*d,* for spouting hot water mixed with shampoo agent or conditioner agent.

There is also provided a step at the bottom wall 2*d* of the cistern 2, such that the bottom wall 2*d* is shallower at the side of the neck receiving part 3 and deeper at the rear side.

Shower heads S1,S4,S6,S8,S9, and nozzle heads N3, N4 and N5 disposed at the shallow part of the bottom wall 2*d*, while a drain outlet 4 is disposed at the deep part of the bottom wall 2*d*.

In the hair washer of the first embodiment, a slender groove 100 (shown by dotted lines in FIG. 1) extending toward the drain outlet 4 and passing through both sides of shower heads S8 and S9 is provided at the bottom wall 2*d* and is disposed at the shallow side of the neck receiving part 3 of the cistern 2. In addition, a slender groove (shown by dotted lines in FIG. 1) extending toward the drain outlet 4 passing through both sides of shower heads S4 and S6 is provided at the deeper side of the bottom wall 2*d*.

In use, the hair washing operation is started by the person inserting his head into the cistern 2 while lying on his back. Hot water is spouted out from shower heads S1 to S12 for a predetermined period of time.

Next, hot water is spouted out from the shower heads S1 to S12, along with hot water mixed with shampoo agent being spouted out from the nozzle heads N1 to N6, and shampooing of the head hair is carried out.

After the shampooing process is completed, the hair is rinsed. The spouting of hot water mixed with shampooing agent from the nozzle heads N1 to N6 is stopped and rising of the shampooing agent in the head hair is carried out by hot water spouted out from shower heads S1 to S12.

After the rinsing process is completed, the hair is conditioned, and then rinsed, as in the prior art hair washer, thereby completing the whole hair washing process.

In the above-described hair washing process, both the hot water spouted on the heads of the person under hair washing from shower heads S1 to S12 and the hot water mixed with shampoo agent or conditioner agent spouted from nozzle heads N1 to N6 are exhausted from the drain outlet 4 through the groove 100 provided at the bottom wall 2*d* of the cistern 2. In other words, the exhaustion of water after the hair washing is performed by flowing the water along the bottom wall 2*d* of the cistern 2 so as not to suppress the spouting of hot water from the shower heads S and nozzle heads N on the bottom wall 2*d* of the cistern 2, thereby keeping the pressure of spouting of such as hot water from the shower heads S and the nozzle heads N on the bottom wall 2*d* of the cistern 2 at a predetermined pressure, and resulting in an effective washing of the rear head part of the person undergoing washing.

In the present invention when the depth of the groove 100 is made sufficiently deep or the groove 2 is provided at the entire surface of the bottom wall 2*d* which is provided at the side of the neck receiving part of the cistern 100, the above-described effects can be assuredly obtained.

In this way, in the hair washer according to the first embodiment of the present invention, hot water spouted from the shower heads S1 to S12 and the nozzle heads N1 to N6 are exhausted from the drain outlet 4 through the groove 100 provided at the bottom wall of the cistern 2, whereby the pressure of hot water spouting from the shower heads S and the nozzle heads N provided on the bottom wall 2*d* of the cistern 2 can be kept at a predetermined pressure value during the entire hair washing process, thereby resulting in an effective washing of the head part of the person under hair washing.

What is claimed is:

1. A hair washing comprising:

a cistern into which the head part of a person under hair washing can be inserted, said cistern comprising side wall surfaces, a front wall surface, a rear wall surface and a bottom wall surface, said bottom wall surface having a front part and a rear part, wherein a portion of the side wall surface and the front part of the bottom wall surface are collectively substantially U-shaped when viewed in cross-section;

a plurality of washing nozzles for spouting out washing water, provided at each of said side wall surface and rear wall surface, and a plurality of pairs of washing nozzles provided at said front part of the bottom wall surface of the cistern;

a drain outlet for draining washing water spouted from the washing nozzles, said drain outlet provided at the rear part of the bottom wall surface of the cistern;

grooves extending toward the drain outlet, at least one said grooves being provided between each adjacent pair of said washing nozzles located at the front part of the bottom wall surface of the cistern;

wherein washing water spouted from the washing nozzles passes through said grooves and is drained through the drained outlet so that said drain water does not interfere with the water spouted from the washing nozzles, whereby the pressure of the water spouted from the washing nozzles remains substantially constant.

* * * * *